US010773929B2

(12) United States Patent
Ma et al.

(10) Patent No.: US 10,773,929 B2
(45) Date of Patent: Sep. 15, 2020

(54) SHEAVE FOR ELEVATOR SYSTEM

(71) Applicant: Otis Elevator Company, Farmington, CT (US)

(72) Inventors: Jun Ma, Farmington, CT (US); Peter Keyo, Canton, CT (US); Brad Guilani, Woodstock Valley, CT (US); Gopal R. Krishnan, Wethersfield, CT (US); David J. Lanesey, Harwinton, CT (US); John P. Wesson, West Hartford, CT (US); David R. Polak, Glastonbury, CT (US); Vijay Jagdale, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 355 days.

(21) Appl. No.: 15/500,143

(22) PCT Filed: Jul. 30, 2015

(86) PCT No.: PCT/US2015/042889
§ 371 (c)(1),
(2) Date: Jan. 30, 2017

(87) PCT Pub. No.: WO2016/019135
PCT Pub. Date: Feb. 4, 2016

(65) Prior Publication Data

US 2017/0267497 A1 Sep. 21, 2017

Related U.S. Application Data

(60) Provisional application No. 62/031,261, filed on Jul. 31, 2014.

(51) Int. Cl.

| | |
|---|---|
| ***B66B 15/04*** | (2006.01) |
| ***B66B 9/00*** | (2006.01) |
| ***B66B 15/02*** | (2006.01) |

(52) U.S. Cl.
CPC ..... *B66B 15/04* (2013.01); *B66B 9/00* (2013.01); *B66B 15/02* (2013.01)

(58) Field of Classification Search
CPC ..... B66B 15/04; B66B 15/06
See application file for complete search history.

(56) References Cited

U.S. PATENT DOCUMENTS 3,692,280 A * 9/1972 Eastcott ..... B66B 15/04 242/610.4
4,434,873 A * 3/1984 Ohta ..... B66B 7/1223 187/277

(Continued)

FOREIGN PATENT DOCUMENTS

CN 201525684 U 7/2010
CN 201621248 11/2010

(Continued)

OTHER PUBLICATIONS

English Machine Translation of JP 2009-068640 dated 2009.*

(Continued)

*Primary Examiner* — Diem M Tran
(74) *Attorney, Agent, or Firm* — Cantor Colburn LLP

(57) ABSTRACT

A belted elevator system (10) includes a hoistway (14) and an elevator car (12) suspended in the hoistway (14) via a suspension member (16) and drivable along the hoistway (14). The suspension member (16) is routed over a plurality of sheaves (18). A sheave (18) of the plurality of sheaves includes a shaft (36) defining a central axis of the sheave (18), the sheave (18) rotatable about the central axis. A sheave outer member (38) is operably connected to the shaft (36) and rotatable about the central axis. The sheave outer member (38) includes a sheave outer surface (44) interactive with the suspension member (16). The sheave outer member (38) is formed from a molded plastic material.

8 Claims, 9 Drawing Sheets

(56) References Cited

U.S. PATENT DOCUMENTS

| | | | | |
|---|---|---|---|---|
| 4,465,161 | A * | 8/1984 | Ohta | B66B 15/04 187/255 |
| 5,067,608 | A | 11/1991 | Mclellan | |
| 5,507,698 | A * | 4/1996 | Kuribayashi | F16H 55/48 474/170 |
| 6,386,324 | B1 | 5/2002 | Baranda et al. | |
| 8,069,955 | B2 | 12/2011 | Aulanko et al. | |
| 8,132,789 | B2 | 3/2012 | Graebner | |
| 2004/0256180 | A1 | 12/2004 | Eichhorn et al. | |
| 2011/0259676 | A1 | 10/2011 | Nardi et al. | |
| 2013/0292211 | A1* | 11/2013 | Polak | B66B 15/04 187/254 |
| 2015/0210511 | A1* | 7/2015 | Zapf | B66B 15/04 187/266 |
| 2016/0236909 | A1* | 8/2016 | Lampinen | B66B 15/04 |

FOREIGN PATENT DOCUMENTS

| | | | |
|---|---|---|---|
| CN | 103328368 | A | 9/2013 |
| CN | 103459294 | A | 12/2013 |
| CN | 103569834 | A | 2/2014 |
| EP | 1902994 | A1 | 3/2008 |
| EP | 2679532 | A1 | 6/2012 |
| EP | 1968878 | B1 | 10/2012 |
| EP | 2684831 | A1 | 1/2014 |
| ES | 2342805 | A1 | 7/2010 |
| JP | 2009068640 | A | 2/2009 |
| WO | 2013172824 | A1 | 11/2013 |

OTHER PUBLICATIONS

Chinese Office Action Issued in CN Application No. 201580041922.X, dated Jul. 2, 2018, 8 Pages.

Cixi Jingrui Bearing Co., Ltd.; 2016; Elevator Pulley /Lift Wheel/Plastic Wheel/Non-Standard Ball Bearing (JR045); Retrived from http://china-roller.en.made-in-china.com/product/KXEmnJPvVYWI/China-Elevator-Elevator Pulley /LiftWheel/Plastic Wheel/Non-Standard Ball Bearing (JR045)-C.

Notification of Transmittal of the International Search Report and the Written Opinion of the International Searching Authority, or the Declaration; Application No. PCT/US2015/042889; dated Nov. 4, 2015; 13 pages.

Seekpart.com; 2013 New Plastic Idler Pulley; Retrived from www. Belt, Overhead, Vertical, 24Volt Table-Top, Drag Chain, Magnetic etc Go to acgconveyors.com.

* cited by examiner

SHEAVE FOR ELEVATOR SYSTEM

CROSS REFERENCE TO RELATED APPLICATIONS

This application claims priority to PCT Patent Application No. PCT/US15/42889 filed Jul. 30, 2015 which claims benefit to the Provisional Application No. 62/031,261 filed Jul. 31, 2014, the entire contents of which is incorporated herein by reference.

BACKGROUND OF THE INVENTION

The subject matter disclosed herein relates to elevator systems. More particularly, the present disclosure relates to sheave configurations for elevator systems.

A typical elevator system includes an elevator car that moves along a hoistway. The elevator car is suspended in the hoistway and driven along the hoistway by one or more tension members, such as a coated steel belt. The coated steel belt is operably connected to the elevator car, and driven by a motor to propel the elevator car along the hoistway. Coated steel belts in particular include a plurality of wires located at least partially within a jacket material. The plurality of wires is often arranged into one or more strands and the strands are then arranged into one or more cords. In an exemplary belt construction, a plurality of cords is typically arranged equally spaced within a jacket in a longitudinal direction.

The motor drives a sheave, in this case a traction sheave, over which the coated steel belt is routed. The belt gains traction at the traction sheave, such that rotation of the traction sheave consequently drives movement of the elevator car. The coated steel belt is then routed over one or more idler or deflector sheaves to guide the belt between the traction sheave and the elevator car. The idler or deflector sheaves are utilized to route the tension member and to maintain a desired tension thereat. Such sheaves are typically formed from steel, with a coating, such as a nickel plating, applied to the outer sheave surface that is interactive with the tension member. Due to the high surface energy of the metal surface, the tension member to sheave interface can generate noise as a result of strain energy buildup and release in the jacket.

BRIEF DESCRIPTION OF THE INVENTION

In one embodiment, a sheave for a belted elevator system includes a shaft defining a central axis of the sheave, the sheave rotatable about the central axis. A sheave outer member is operably connected to the shaft via at least one bearing and rotatable about the central axis. The sheave outer member is interactive with a tension member of the elevator system. The sheave outer member is formed from a molded plastic material.

Alternatively or additionally, in this or other embodiments the sheave outer member is supported at the bearing by a metallic support member.

Alternatively or additionally, in this or other embodiments the metallic support member is a tubular insert disposed radially inboard of the sheave outer surface.

Alternatively or additionally, in this or other embodiments the metallic support member is embedded in the sheave outer member.

Alternatively or additionally, in this or other embodiments the metallic support member comprises a plurality of metallic rings molded into the sheave outer member.

Alternatively or additionally, in this or other embodiments the sheave outer member is formed from one or more of filled or unfilled polymers including but not limited to an ultra high molecular weight polyethylene, nylon, polyethylene terephthalate (PET) material, or an acetal resin material such as polyoxymethylene.

Alternatively or additionally, in this or other embodiments the sheave outer member includes a sheave outer surface interactive with the tension member, the sheave outer surface including one or more dimples, bumps, ridges, slits, depressions, or roughness elements configured to inhibit noise.

In another embodiment, a belted elevator system includes a hoistway and an elevator car suspended in the hoistway via a suspension member and drivable along the hoistway. The suspension member is routed over a plurality of sheave. A sheave of the plurality of sheaves includes a shaft defining a central axis of the sheave, the sheave rotatable about the central axis. A sheave outer member is operably connected to the shaft and rotatable about the central axis. The sheave outer member includes a sheave outer surface interactive with the suspension member. The sheave outer member is formed from a molded plastic material.

Alternatively or additionally, in this or other embodiments the sheave outer member is supported at the shaft by a metallic support member.

Alternatively or additionally, in this or other embodiments the metallic support member is one of a tubular insert disposed radially inboard of the sheave outer surface or a plurality of metallic rings molded into the sheave outer member.

Alternatively or additionally, in this or other embodiments the metallic support member is embedded in the sheave outer member.

Alternatively or additionally, in this or other embodiments the sheave outer member is formed from one or more of filled or unfilled polymers including but not limited to an ultra high molecular weight polyethylene, nylon, polyethylene terephthalate (PET) material, or an acetal resin material such as polyoxymethylene (POM).

Alternatively or additionally, in this or other embodiments the sheave outer surface includes one or more dimples, bumps, ridges, slits, depressions, or roughness elements configured to inhibit noise.

In yet another embodiment, a sheave assembly for a belted elevator system includes a shaft defining a central axis of the sheave assembly and a plurality of sheaves disposed along the shaft. Each sheave of the plurality of sheaves is rotatable about the central axis and includes a sheave outer member operably connected to the shaft via at least one bearing and rotatable about the central axis. The sheave outer member is interactive with a tension member of the elevator system. The sheave outer member is formed from a molded plastic material and includes one or more dimples, bumps, ridges, slits, depressions, or roughness elements configured to inhibit noise.

Alternatively or additionally, in this or other embodiments a first sheave of the plurality of sheaves utilizes a first configuration of noise inhibiting features and a second sheave of the plurality of sheaves utilizes a second configuration of noise inhibiting features, different from the first configuration.

The detailed description explains the invention, together with advantages and features, by way of examples with reference to the drawings.

DETAILED DESCRIPTION OF THE INVENTION

Figure 1A:
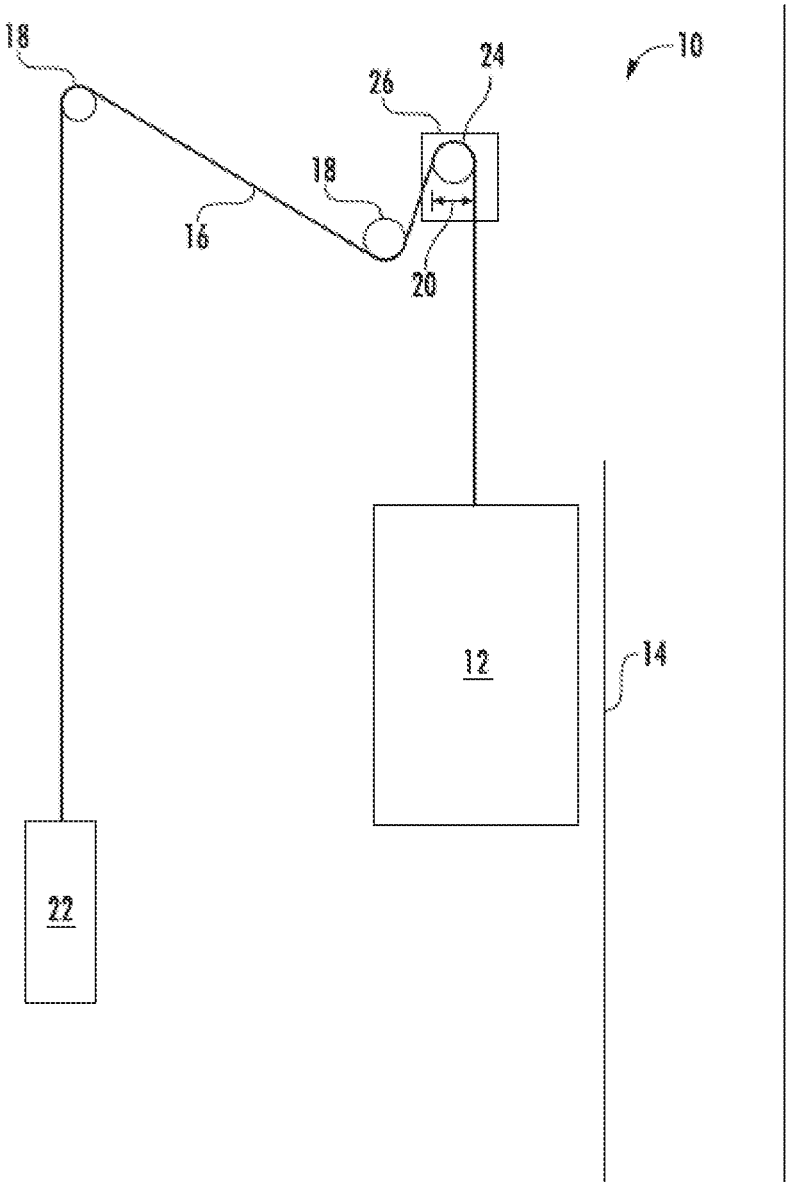
FIG. 1A is a schematic of an exemplary elevator system having a 1:1 roping arrangement.
Figure 1B:
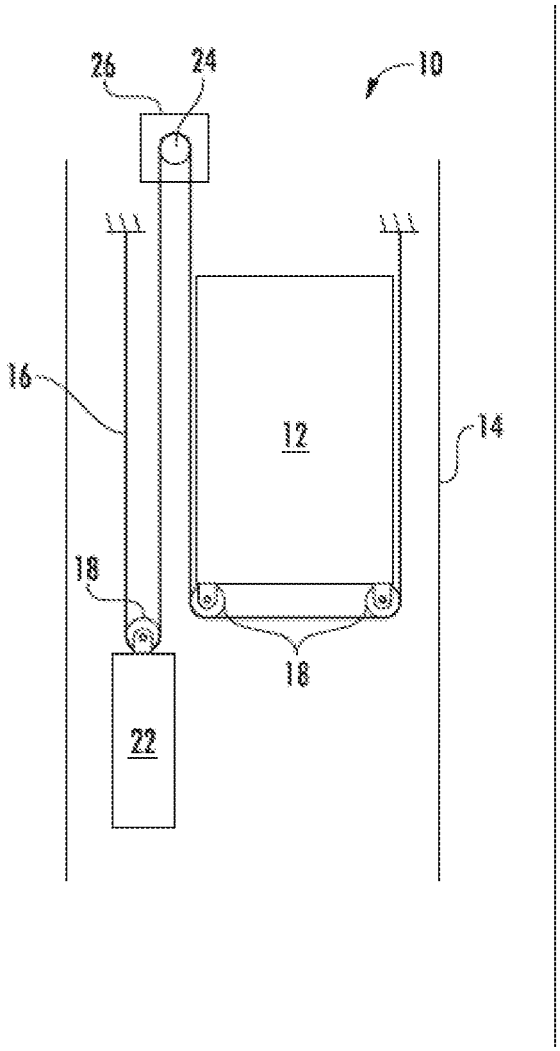
FIG. 1B is a schematic of another exemplary elevator system having a different roping arrangement.
Figure 1C:
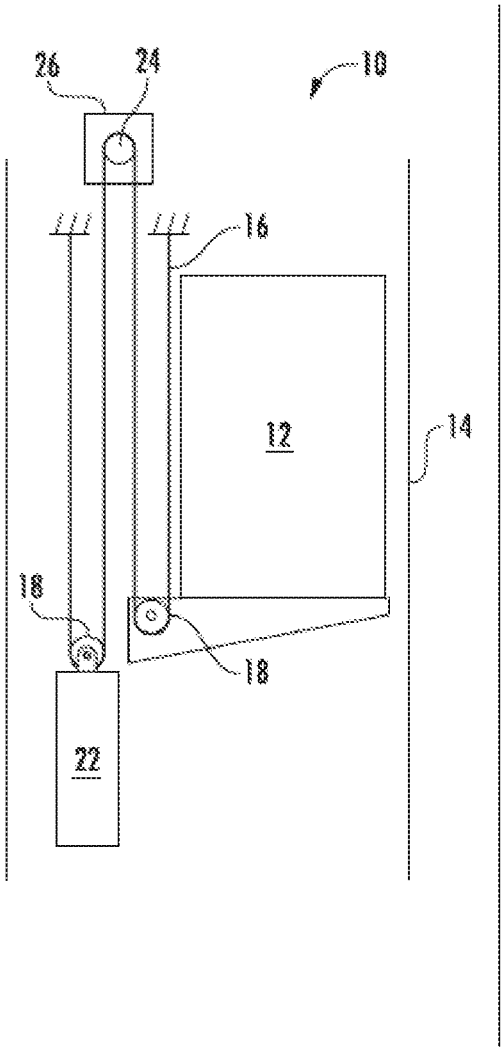
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation. It is to be appreciated that while the embodiments herein are described as applied to coated steel belts, it is to be appreciated that the disclosure herein may similarly be applied to steel ropes, either coated or uncoated.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of the traction sheave 24 by the machine 26 drives, moves and/or propels (through traction) the one or more belts 16 that are routed around the traction sheave 24.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room). The number of sheaves 18 used in the arrangement determines the specific roping ratio (e.g., the 2:1 roping ratio shown in FIGS. 1B and 1C or a different ratio). FIG. 1C also provides a cantilevered type elevator. The present invention could be used on elevator systems other than the exemplary types shown in FIGS. 1A, 1B and 1C.

Figure 2:
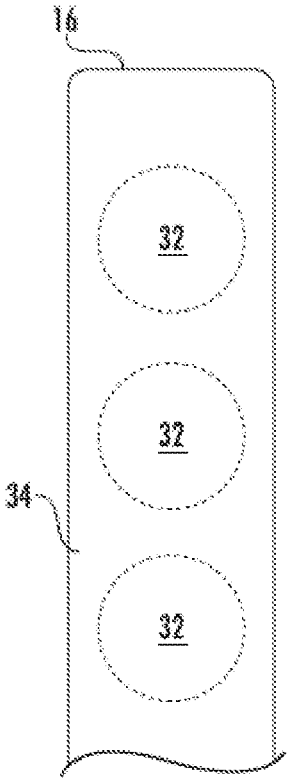
FIG. 2 is a schematic view of an embodiment of an elevator belt for an elevator system.
Figure 3:
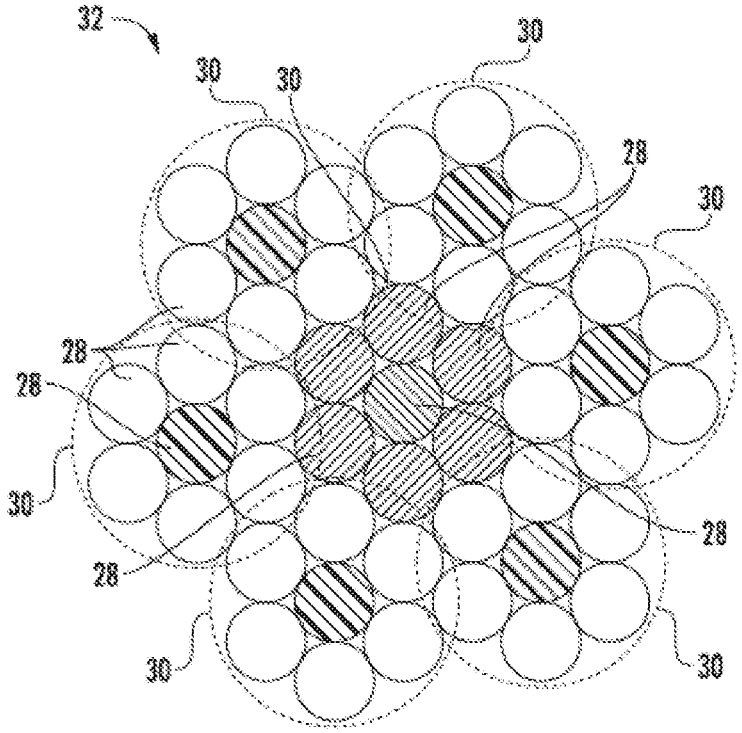
FIG. 3 is a cross-sectional view of an embodiment of a cord for an elevator belt.

FIG. 2 provides a schematic of a belt construction or design. Each belt 16 is constructed of a plurality of wires 28 (e.g. twisted into one or more strands 30 and/or cords 32 as shown in FIG. 3) in a jacket 34. As seen in FIG. 2, the belt 16 has an aspect ratio greater than one (i.e. belt width is greater than belt thickness). The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12. The jacket 34 could be any suitable material, including a single material, multiple materials, two or more layers using the same or dissimilar materials, and/or a film. In one arrangement, the jacket 34 could be a polymer, such as an elastomer, applied to the cords 32 using, for example, an extrusion or a mold wheel process. In another arrangement, the jacket 34 could be a woven fabric that engages and/or integrates the cords 32. As an additional arrangement, the jacket 34 could be one or more of the previously mentioned alternatives in combination.

The jacket 34 can substantially retain the cords 32 therein. The phrase substantially retain means that the jacket 34 has sufficient engagement with the cords 32 to transfer torque from the machine 26 through the jacket 34 to the cords 32 to drive movement of the elevator car 12. The jacket 34 could completely envelop the cords 32 (such as shown in FIG. 2), substantially envelop the cords 24, or at least partially envelop the cords 32.

Figure 4:
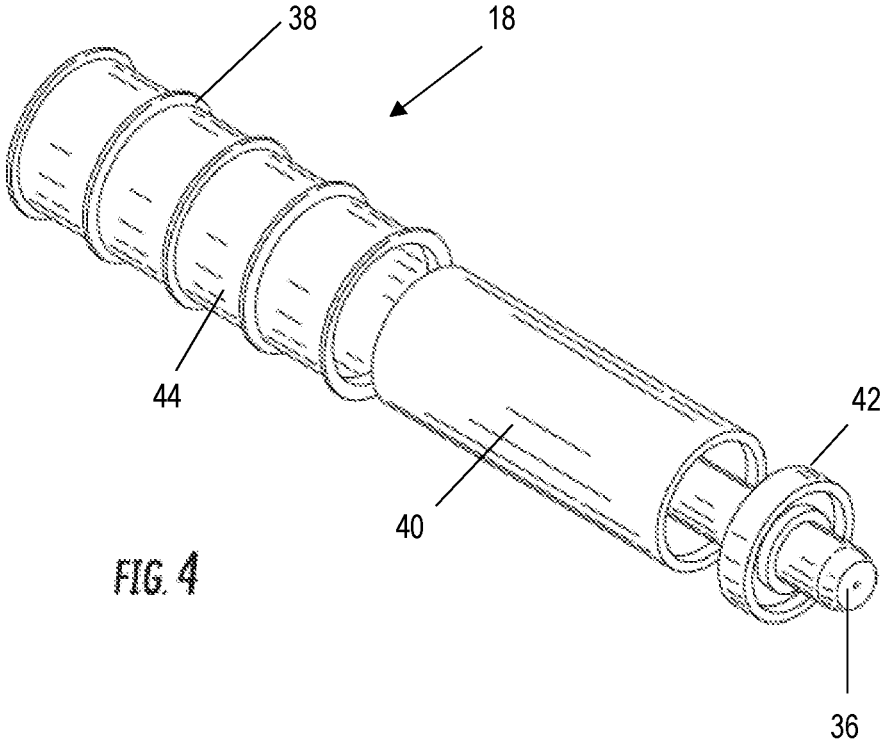
FIG. 4 is a partially exploded view of an embodiment of a sheave for an elevator system.

Referring now to FIG. 4, in some embodiments, the sheave 18 includes a shaft 36 and a sleeve 38, with a tubular sheave insert 40 and a bearing 42 interposed between the sleeve 38 and the shaft 36 to transfer loads therebetween. The sheave insert 40 is formed from, for example, a metal or composite material having a high lateral stiffness and a high bending stiffness. The sleeve 38, however, is formed from a plastic material, for example, filled or unfilled polymers including but not limited to an ultra high molecular weight polyethylene, nylon, polyethylene terephthalate (PET) material, or an acetal resin material such as polyoxymethylene (POM). The sleeve 38 is secured to the sheave insert 40 to prevent lateral and circumferential sliding between the two components. For example, the sleeve 38 may be molded onto the sheave insert 40, or may be pressed onto the sheave insert 40 with an interference fit. In other embodiments, the sleeve 38 is secured to the sheave insert 40 via mechanical fasteners such as a plurality of bolts installed through noise inhibiting holes in the sleeve 38.

Figure 5:
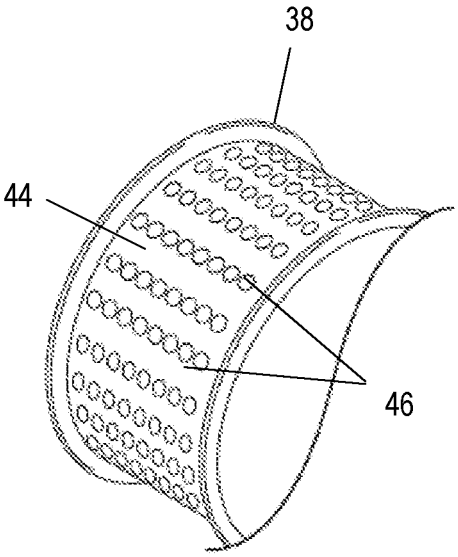
FIG. 5 is a perspective view of an embodiment of a sheave outer surface having exemplary noise inhibiting features.

The plastic sleeve 38 allows for tuning of the sheave 18 structure to reduce noise. The plastic material typically has a lower surface energy than a steel material utilized in a typical sheave, thus more easily enabling a low friction interface between the sheave 18 and belt 16 at a sheave outer surface 44 of the sleeve 38. In some embodiments, the outer surface 44 is crowned. Further, the sheave 18 may include multiple sheave outer surfaces 44 to interface with multiple belts 16. For example, the sheave 18 may have three sheave outer surfaces 44 arranged across a width of the sheave 18 to interface with three belts 16. Further, as shown in FIG. 5, the plastic sleeve 38 allows for optimally choosing friction and surface roughness of the plastic sleeve 38, by molding noise inhibiting features such as the shown dimples 46, or other features such a bumps, ridges, slits, depressions, roughness elements or the like, into the plastic sleeve 38 to reduce noise between the belt 16 and the sheave 18.

Figure 6:
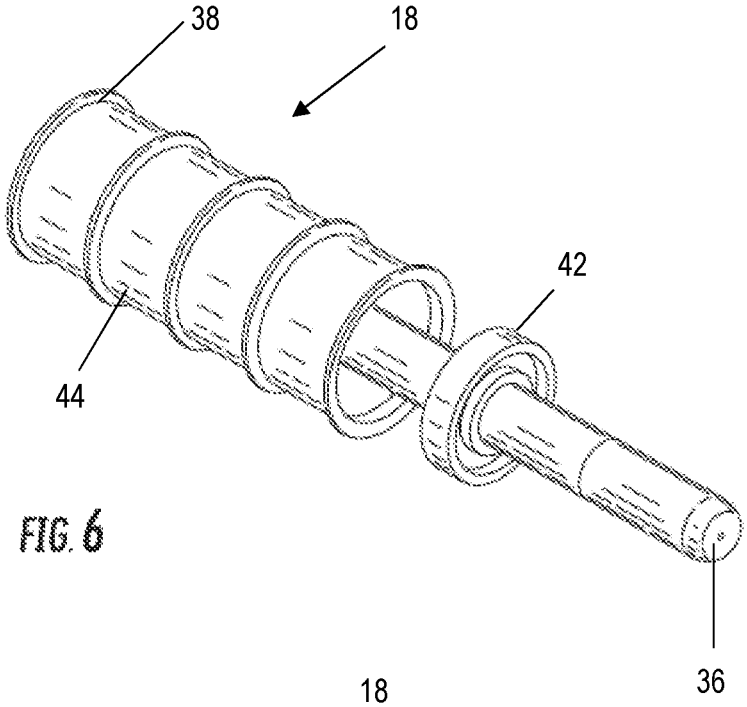
FIG. 6 is a partially exploded view of another embodiment of a sheave for an elevator system.
Figure 7:
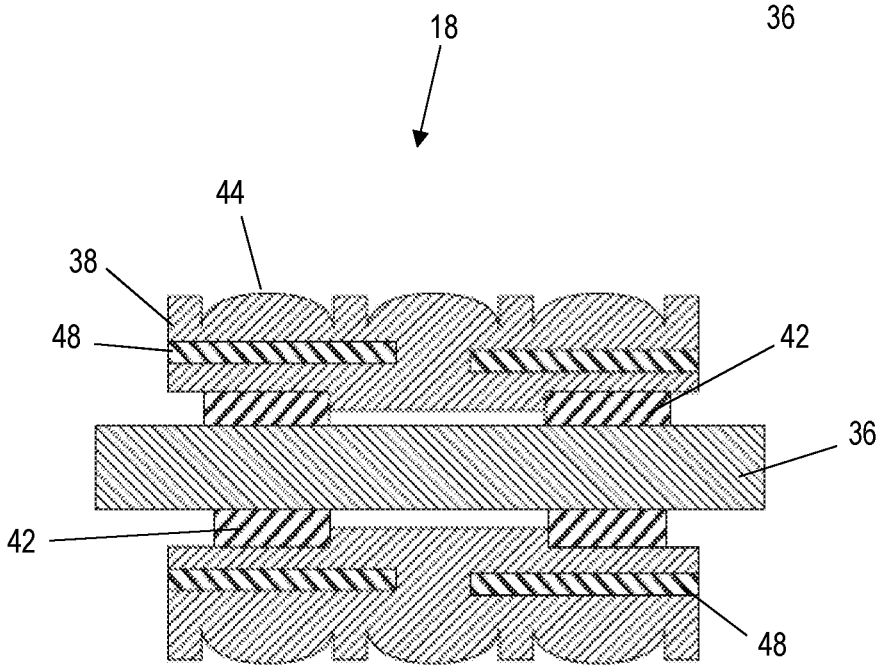
FIG. 7 is a cross-sectional view of an embodiment of a sheave for an elevator system.
Figure 8:
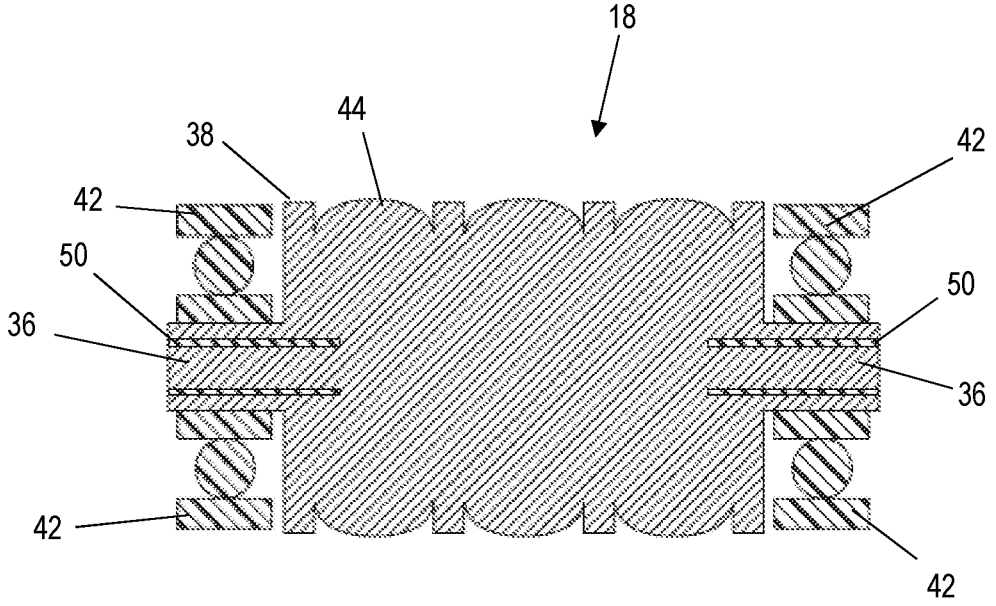
FIG. 8 is a cross-sectional view of another embodiment of a sheave for an elevator system.
Figure 9:
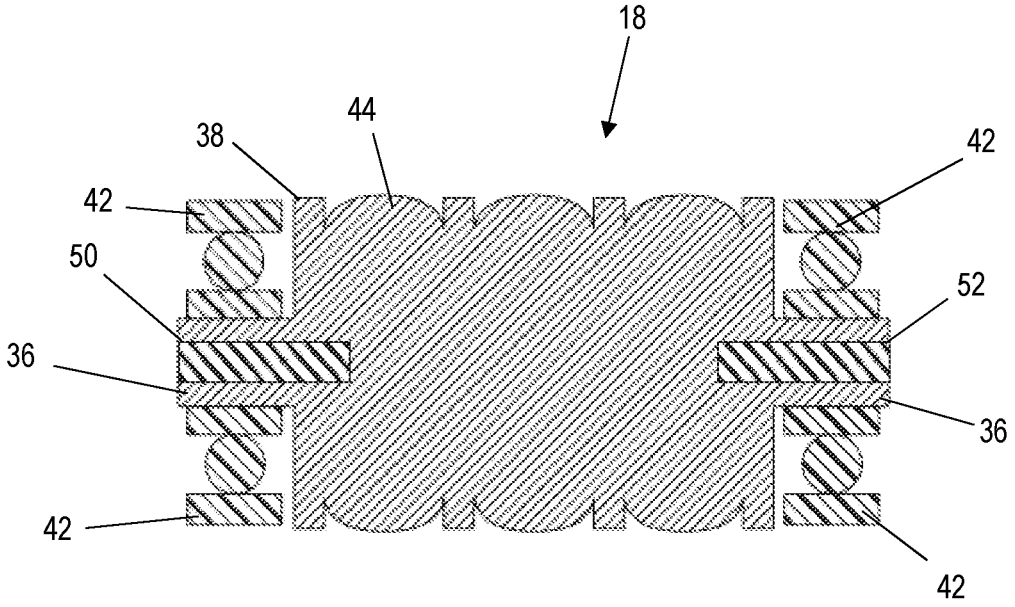
FIG. 9 is a cross-sectional view of yet another embodiment of a sheave for an elevator system.

Referring now to FIG. 6, in some embodiment if load conditions allow, the sheave 18 may be formed with the plastic sleeve 38, but without the tubular sheave insert 40 further saving weight and material and thus cost. In embodiments with or without the tubular sheave insert 40, the sleeve 38 may include other reinforcement of metal or composite materials to strengthen the sheave 18 and allow for effective load transfer to the bearing 42, as shown in FIGS. 7-9. In the embodiment of FIG. 7, reinforcing rings 48 formed from, for example, steel, are inserted into the plastic sleeve 38. The reinforcing rings 48 are positioned at a same axial position as the bearing 42 for effective load transfer from the sleeve 38 to the bearing 42. In some embodiments, the reinforcing rings 48 are molded into the sleeve 38, while in other embodiments the reinforcing rings 48 are installed in the sleeve 38 after sleeve 38 molding is completed. In some embodiments, multiple reinforcing rings 48 are utilized, as shown in FIG. 7, while in other embodiments such as those of FIG. 7A, a single reinforcing ring 48 extends across a width of the sheave 18.

Referring now to FIGS. 8 and 9, embodiments are illustrated wherein the bearings 42 are external to the sleeve 38, and the shaft 36 rotates with the sleeve 38 as the belt 16 passes over the sleeve 38. This is contrasted with other embodiments, such as those of FIG. 6, where the shaft 36 is fixed relative to the sleeve 38, and the sleeve 38 rotates about the shaft 36 as the belt 16 passes across the sleeve 38. The shaft 36 is formed from plastic, and in some embodiments is integral to the sleeve 38. The bearings 42 are located at the shaft 36, and the shaft 36 is reinforced with either a shaft reinforcing ring 50 as in FIG. 8, or a shaft reinforcing rod 52 as in FIG. 9. As with the embodiment of FIG. 6, the shaft reinforcing ring 50 or the shaft reinforcing rod 52 may be molded into the sleeve 38 or alternatively installed in the sleeve 38 after molding is completed.

Figure 10:
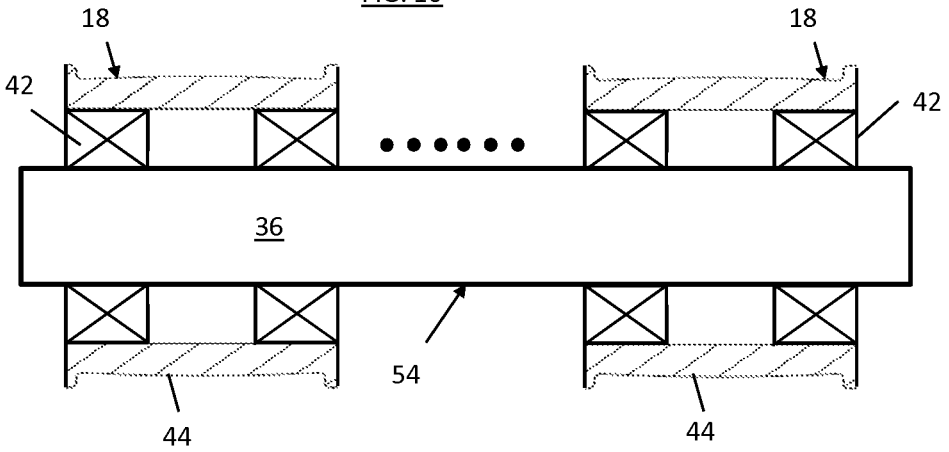
FIG. 10 is a cross-sectional view of an embodiment of a sheave assembly for an elevator system.
Figure 11:
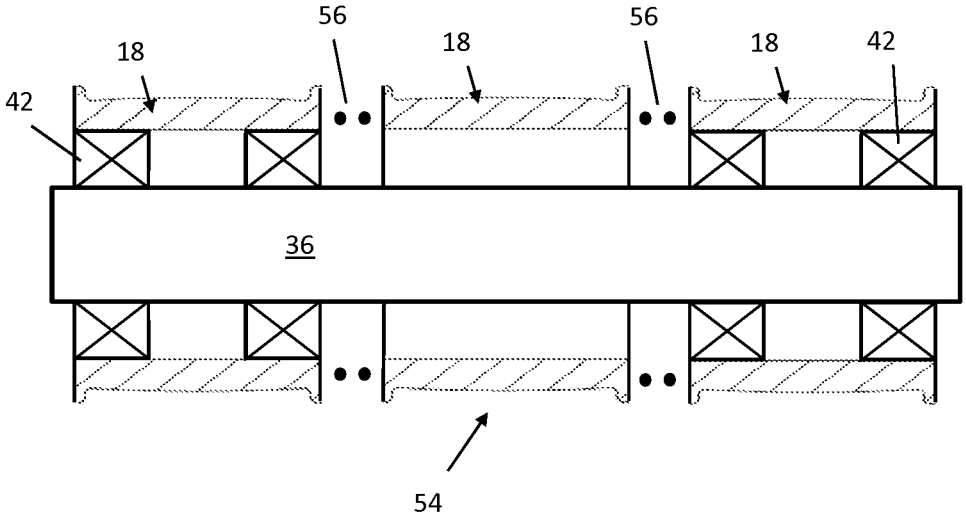
FIG. 11 is a cross-sectional view of another embodiment of a sheave assembly for an elevator system.

Referring to FIG. 10, a sheave assembly 54 may be constructed utilizing a plurality of sheaves 18, arranged along the shaft 36. In some embodiments, a bearing 42 is located at each sheave 18 of the plurality of sheaves. Alternatively, as shown in FIG. 11, bearings 46 are located at end sheaves 18 of the sheave assembly 54, and the remaining sheaves 18 are connected to the end sheaves 18 via a connecting means 56, such as a pin, fastener, weld or adhesive. Such modular construction of the sheave assembly 54 allows individual sheaves 18 to be tuned differently based on specific operating conditions by utilizing different configurations of noise inhibiting features, utilizing different materials, different reinforcing means or the like.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A sheave for a belted elevator system comprising:

a shaft defining a central axis of the sheave, the sheave rotatable about the central axis; and a sheave outer member operably connected to the shaft via at least one bearing and rotatable about the central axis, the sheave outer member interactive with a tension member of the elevator system, the sheave outer member formed from a molded plastic material;

wherein the sheave outer member is supported at the bearing by a metallic support member;

wherein the metallic support member comprises a plurality of metallic rings molded into the sheave outer member, the plurality of metallic rings along a direction parallel to the central axis;

wherein the tension member of the elevator system is a belt having an aspect ratio of belt width to belt thickness greater than one.

2. The sheave of claim 1, wherein the metallic support member is a tubular insert disposed radially inboard of the sheave outer surface.

3. The sheave of claim 1, wherein the sheave outer member is formed from one or more of filled or unfilled polymers including but not limited to an ultra high molecular weight polyethylene, nylon, polyethylene terephthalate (PET) material, or an acetal resin material such as polyoxymethylene.

4. The sheave of claim 1, wherein the sheave outer member includes a sheave outer surface interactive with the tension member, the sheave outer surface including one or more dimples configured to inhibit noise.

5. A belted elevator system comprising:

a hoistway; and an elevatorcar suspended in the hoistway via a suspension member and drivable along the hoistway; and a plurality of sheaves over which the suspension member is routed, a sheave of the plurality of sheaves including:

a shaft defining a central axis of the sheave, the sheave rotatable about the central axis; and a sheave outer member operably connected to the shaft and rotatable about the central axis, the sheave outer member including a sheave outer surface interactive with the suspension member, the sheave outer member formed from a molded plastic material;

wherein the sheave outer member is supported at the shaft by a metallic support member;

wherein the metallic support member comprises a plurality of metallic rings molded into the sheave outer member, the plurality of metallic rings along a direction parallel to the central axis; and wherein the suspension member of the elevator system is a belt having an aspect ratio of belt width to belt thickness greater than one.

6. The elevator system of claim 5, wherein the sheave outer member is formed from one or more of filled or unfilled polymers including but not limited to an ultra high molecular weight polyethylene, nylon, polyethylene terephthalate (PET) material, or an acetal resin material such as polyoxymethylene (POM).

7. The elevator system of claim 5, wherein the sheave outer surface includes one or more dimples configured to inhibit noise.

8. A sheave assembly for a belted elevator system comprising:

a shaft defining a central axis of the sheave assembly; and a plurality of sheaves disposed along the shaft, each sheave of the plurality of sheaves rotatable about the central axis and including:

a sheave outer member operably connected to the shaft via at least one bearing and rotatable about the central axis, the sheave outer member interactive with a tension member of the elevator system, the sheave outer member formed from a molded plastic material, the sheave outer surface including one or more configured to inhibit noise;

wherein the sheave outer member is supported at the bearing by a metallic support member;

wherein the metallic support member comprises a plurality of metallic rings molded into the sheave outer member, the plurality of metallic rings along a direction parallel to the central axis; and wherein the tension member of the elevator system is a belt having an aspect ratio of belt width to belt thickness greater than one.

* * * * *